US011084054B2

(12) United States Patent
Liang

(10) Patent No.: US 11,084,054 B2
(45) Date of Patent: Aug. 10, 2021

(54) LOTION PUMP

(71) Applicant: MAJESTY PACKAGING SYSTEMS LIMITED, Guangdong (CN)

(72) Inventor: Jinkao Liang, Zhongshan (CN)

(73) Assignee: MAJESTY PACKAGING SYSTEMS LIMITED, Zhongshan (CN)

( * ) Notice: Subject to any disclaimer, the term of this patent is extended or adjusted under 35 U.S.C. 154(b) by 0 days.

(21) Appl. No.: 16/652,168

(22) PCT Filed: Aug. 26, 2019

(86) PCT No.: PCT/CN2019/102546
§ 371 (c)(1),
(2) Date: Mar. 30, 2020

(87) PCT Pub. No.: WO2020/043053
PCT Pub. Date: Mar. 5, 2020

(65) Prior Publication Data

US 2020/0246820 A1 Aug. 6, 2020

(30) Foreign Application Priority Data

Aug. 27, 2018 (CN) ..... 201821392783.2

(51) Int. Cl.
*B05B 11/00* (2006.01)

(52) U.S. Cl.
CPC ..... *B05B 11/306* (2013.01); *B05B 11/0089* (2013.01); *B05B 11/3026* (2013.01); *B05B 11/3047* (2013.01)

(58) Field of Classification Search
CPC ..... B05B 11/306; B05B 11/0089; B05B 11/3026; B05B 11/3047
See application file for complete search history.

(56) References Cited

U.S. PATENT DOCUMENTS 5,401,148 A 3/1995 Foster et al.
5,445,299 A * 8/1995 Harriman ..... B05B 11/306 215/254

(Continued)

FOREIGN PATENT DOCUMENTS

CN 204473471 U 7/2015
CN 106144191 A 11/2016

(Continued)

OTHER PUBLICATIONS

Nov. 1, 2019 Search Reprot issued in International Patent Application No. PCT/CN2019/102546.

(Continued)

*Primary Examiner* — Donnell A Long
(74) *Attorney, Agent, or Firm* — Oliff PLC

(57) ABSTRACT

A lotion pump includes a pump body with a pump chamber, the pump body is connected with a bottle-locking cap used for fixing the bottle body, and the pump chamber is internally provided with a pumping assembly capable of moving up and down in the pump chamber to pump lotion in the bottle body upwards; the lower end of the pump chamber with a one-way valve only for discharging the lotion in the bottle body upwards during the pumping assembly, the upper end of the pumping assembly is connected with a bent mouth for discharging the lotion, the bent mouth with a connecting ring, the upper end of the pump body with a locking part capable of being rotationally connected with the connecting ring, and an anti-slipping structure between the locking part and the connecting ring for preventing the bent mouth from being unscrewed and opened mistakenly.

8 Claims, 7 Drawing Sheets

(56) References Cited

U.S. PATENT DOCUMENTS

| | | | | |
|---|---|---|---|---|
| 6,604,656 | B1 | 8/2003 | Tseng | |
| 2008/0290119 | A1* | 11/2008 | Tseng | B05B 11/3001 222/321.7 |
| 2017/0128966 | A1* | 5/2017 | Law | B05B 11/0027 |
| 2017/0128967 | A1 | 5/2017 | Law et al. | |

FOREIGN PATENT DOCUMENTS

| | | | |
|---|---|---|---|
| CN | 103879653 | B | 1/2017 |
| CN | 207329221 | U | 5/2018 |
| CN | 208915807 | U | 5/2019 |
| JP | H07-328496 | A | 12/1995 |
| JP | H10-43646 | A | 2/1998 |
| JP | 2013-169984 | A | 9/2013 |
| JP | 2017-516718 | A | 6/2017 |

OTHER PUBLICATIONS

Nov. 1, 2019 Written Opinion issued in International Patent Application No. PCT/CN2019/102546.
Jul. 17, 2020 Extended European Search Report issued in European Patent Application No. 19848921.3.
Feb. 20, 2019 Office Action issued in Chinese Patent Application No. 201821392783.2.
Jan. 20, 2021 Office Action issued in Japanese Patent Application No. 2020-511810.

* cited by examiner

LOTION PUMP

TECHNICAL FIELD

The present invention relates to lotion pump.

BACKGROUND ART

Lotion pumps have been widely used in daily chemicals, medicine and other industries because of exquisite designs and convenience. The existing lotion pumps have the following defects, including: 1. absence of anti-slipping function for the elbow or the bent mouth of the lotion pump, which leads to leakage of liquid in the bottle if the elbow is unscrewed and opened by mistake due to collision or vibration during shipping; 2. direct contact of the return spring of the pumping assembly of the conventional lotion pump with the lotion in the pump chamber, which leads to pollution and insalubrity if the return spring rusts; 3. a chance for air, water and other impurities to enter the pump chamber through a gap between the elbow and the pump body after the elbow of the existing lotion pump is unscrewed and opened, which leads to pollution to the lotion, shown to be insalubrious and not environmental friendly; and 4. a complex structure of the existing lotion pump, which costs much. Accordingly, the present invention is based on the above defects.

SUMMARY OF THE INVENTION

The invention aims to overcome the defects of the prior art, and provide a lotion pump which is simple in structure, low in cost and capable of preventing a bent mouth (also named elbow) from being unscrewed by mistake during shipping.

The invention is implemented according to the following technical solutions: A lotion pump, comprising a pump body 1 extending into a bottle body, the pump body 1 is provided with a pump chamber 2, the pump body 1 is connected with a bottle-locking cap 3 used for fixing the pump body 1 to the bottle body, and the pump chamber 2 is internally provided with a pumping assembly 4 capable of moving up and down in the pump chamber 2 to pump lotion in the bottle body upwards; the pump chamber 2 is provided, at the lower end thereof, with a one-way valve 5 only for discharging the lotion in the bottle body upwards during the action of the pumping assembly 4, the pumping assembly 4 is connected, at the upper end thereof, with a bent mouth 6 for discharging the lotion, the bent mouth 6 is provided with a connecting ring 7, the upper end of the pump body 1 is provided with a locking part 8 capable of being rotationally connected with the connecting ring 7, and an anti-slipping structure is provided between the locking part 8 and the connecting ring 7 for preventing the bent mouth 6 from being unscrewed and opened by mistake along with the connecting ring 7 when the locking part 8 and the connecting ring 7 are connected.

In the lotion pump, the anti-slipping structure comprises an anti-slipping tooth 91/anti-slipping teeth 91 provided on the outer peripheral surface of the locking part 8, and the inner wall of the connecting ring 7 is provided with an elastic bending piece 92/elastic bending pieces 92 which can abut against the anti-slipping tooth/teeth 91 to prevent the connecting ring 7 from being reversed.

In the lotion pump, there are six anti-slipping teeth 91 circumferentially arrayed on the locking part 8, there are two groups of the bending pieces 92 circumferentially arrayed on the connecting ring 7, and each group of the bending pieces 92 has two pieces.

In the lotion pump, the inner wall of the connecting ring 7 is provided with a plurality of tightening pieces 93, and when the connecting ring 7 is connected with the locking part 8, an lower end of each tightening piece 93 abuts against the locking part 8.

In the lotion pump, the lower end of the pump chamber 2 is conical, and the one-way valve 5 is a pump bead provided at the lower end of the pump chamber 2.

In the lotion pump, a diptube 10 is further connected to the pump body 1 below the one-way valve 5.

In the lotion pump, the pumping assembly 4 includes a pump lever 42 connected with the bent mouth 6 and having a liquid pumping channel 41, a piston 43 sleeved outside of the pump lever 42 is provided in the pump chamber 2, the inner wall of the piston 43 is provided with a step/steps 44, and the pump lever 42 is provided with a pushing part/pushing parts 45 which can be in contact with the step/steps 44 to push the piston 43 to move downwards when the pump lever 42 descends a certain distance, the pump lever 42 is further provided, at a lower part thereof, with an outer convex part 46, the lower end of the piston 43 is provided with a sealing lip 47 which can contacted with the outer convex part 46 to cut off the liquid pumping channel 41 from the pump chamber 2 when the pump lever 42 does not descend, and a fixing part 48 allowing the pump lever 42 to slide up and down therein is further provided in the pump chamber 2 above the piston 43; and a return spring 49 which enables the outer convex part 46 and the sealing lip 47 to be contacted and sealed when the connecting ring 7 and the locking part 8 are not connected is provided between the fixing part 48 and the bent mouth 6.

In the lotion pump, the locking part 8 comprises a cover body 81, the cover body 81 is provided with a cylinder 82 extending into the pump chamber 2, the fixing part 48 is disposed at the lower end of the cylinder 82, the outer side of the cylinder 82 is provided with an annular part 83 in threaded connection with the pump body 1, and a placement groove 84 for the upper end of the pump body 1 to be inserted into is formed between the annular part 83 and the cylinder 82, the outer side of the annular part 83 is further provided with a peripheral ring 85 connected with the connecting ring 7 of the bent mouth 6, and the peripheral ring 85, the annular part 83, the cylinder 82, the fixing part 48 and the cover body 81 are integrally formed by injection molding.

In the lotion pump, the bent mouth 6 is provided with a guide cylinder 11 which is positioned on the inner side of the connecting ring 7 and inserted into the cylinder 82, the pump lever 42 is inserted into the guide cylinder 11 and connected with the bent mouth 6, an edge of the opening at the upper end of the cylinder 82 extends inwards to form an extension 86, and the extension 86 is tightly attached to the outer wall of the guide cylinder 11.

In the lotion pump, the lower end of the guide cylinder 11 is tapered, and the anti-slipping tooth/the anti-slipping teeth 91 is/are ratchet/ratchets.

Compared with the prior art, the invention has the following advantages:

1. According to the invention, anti-slipping structure is provided between the locking part and the connecting ring for preventing the bent mouth from being unscrewed and opened by mistake along with the connecting ring when the locking part and the connecting ring are connected. If a bottle body containing lotion is equipped with the lotion pump, despite of vibration or collision during shipping, the anti-slipping structure prevents relative rotation between the connecting ring and the locking part, so that the bent mouth is free of being unscrewed and opened by mistake, leakage of the lotion is prevented, and the product quality is improved.

2. The anti-slipping structure of the invention includes anti-slipping tooth/teeth arranged on the outer peripheral surface of the locking part, and the inner wall of the connecting ring is provided with an elastic bending piece/elastic bending pieces which can abut against the anti-slipping tooth/teeth correspondingly to prevent the connecting ring from being reversed. When the connecting ring is screwed clockwise to the locking part, the anti-slipping tooth/teeth contacts/contact the bending piece/pieces correspondingly and force the bending piece/pieces to deform, when the connecting ring is rotated to a required position, the bending piece/pieces returns/return elastically, the end part/parts of the bending piece/pieces abuts/abut against the anti-slipping tooth/teeth, and at this moment, even if the bottle body filled with lotion is experiencing vibration or collision during shipping, the anti-slipping tooth/teeth abuts/abut against the bending piece/pieces to prevent the connecting ring from being unscrewed anticlockwise; now that the connecting ring is disposed on the bent mouth, the bent mouth can thus not be unscrewed anticlockwise to be opened, and leakage caused by opening of the bent mouth by mistake is avoided. When a user needs to open the bent mouth, he/she may impose a strong force by hand to unscrew the bent mouth, so that the connecting ring is driven along, the bending piece/pieces is/are broken under the strong force, and the bent mouth can be easily opened after the bending piece/pieces is/are broken. Therefore, the bending piece/pieces not only prevents/prevent the bent mouth from being opened by mistake which may cause leakage during shipping of the product, but also plays/play a role of anti-counterfeiting in that after the bending piece/pieces is/are broken, it is impossible for some lawbreakers to replace the lotion in the bottle body with other shoddy goods without being noticed.

3. The return spring of the invention is disposed between the fixing part and the bent mouth and above the piston, so that the return spring cannot contact the lotion when the pump lever moves up and down to pump the lotion into space of the pump chamber below the piston. Therefore, according to the lotion pump structure of the invention, the return spring and the lotion are completely separated, hygiene is guaranteed, and pollution to the lotion is avoided.

4. The edge of the opening at the upper end of the cylinder of the locking part of the invention extends inwards to form the extension, and the extension is tightly attached to the outer wall of the guide cylinder. Therefore, when the guide cylinder is lifted and lowered by pressing the bent mouth, the guide cylinder is always tightly attached to the extension of the cylinder, water or other impurities are prevented from entering the pump chamber, and pollution is avoided.

5. The invention is simple in structure and low in cost, liquid leakage can be prevented in either locked or unlocked state of the bent mouth and the locking part, pollution to the lotion can be prevented, hygiene is guaranteed, and the invention is suitable for popularization.

DETAILED DESCRIPTION OF THE INVENTION

Figure 1:
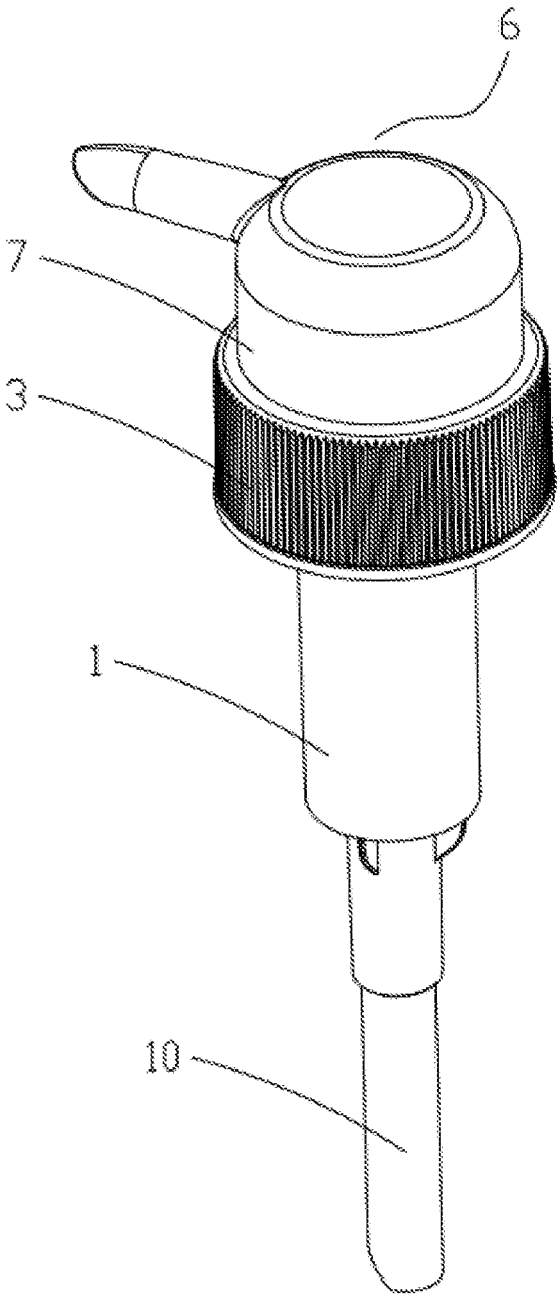
FIG. 1 is a perspective view of the invention when the connecting ring and the locking part are connected.

The invention is further described below with reference to the accompanying drawings:

As shown in FIG. 1, FIG. 2, FIG. 3, FIG. 5 and FIG. 7, a lotion pump comprises a pump body 1 extending into a bottle body, the pump body 1 is provided with a pump chamber 2, and the pump body 1 is connected with a bottle-locking cap 3 for fixing the pump body 1 to the bottle body; the pump chamber 2 is internally provided with a pumping assembly 4 capable of moving up and down in the pump chamber 2 to pump lotion in the bottle body upwards; the pump chamber 2 is provided, at the lower end thereof, with a one-way valve 5 only for discharging the lotion in the bottle body when the pumping assembly 4 operates, the pumping assembly 4 is connected, at the upper end thereof, with a bent mouth 6 for discharging the lotion, the bent mouth 6 is provided with a connecting ring 7, the upper end of the pump body 1 is provided with a locking part 8 capable of being rotationally connected with the connecting ring 7, the locking part 8 is provided with external threads, and an inner wall of the connecting ring 7 is provided with internal threads matching the external threads; and an anti-slipping structure is provided between the locking part 8 and the connecting ring 7 for preventing the bent mouth 6 from being unscrewed and opened by mistake along with the connecting ring 7 when the locking part 8 and the connecting ring 7 are connected. A bottle body is filled with lotion, and the lotion pump is connected to the bottle body through the bottle-locking cap 3, thereby forming products such as daily chemicals or medicines etc. During shipping of the product, the bent mouth 6 is screwed to the locking part 8 by means of the connecting ring 7, with the pumping assembly 4 located at the lower part of the pump chamber 2. Now that the anti-slipping structure is disposed between the connecting ring 7 and the locking part 8, after the connecting ring 7 and the locking part 8 are screwed tightly, the anti-slipping structure prevents relative rotation between the connecting ring and the locking part despite of vibration or collision, thereby avoiding looseness of the connecting ring 7, so that opening by mistake caused by rotation of the bent mouth 6 is avoided, leakage of the lotion is prevented, and product quality is improved.

Figure 2:
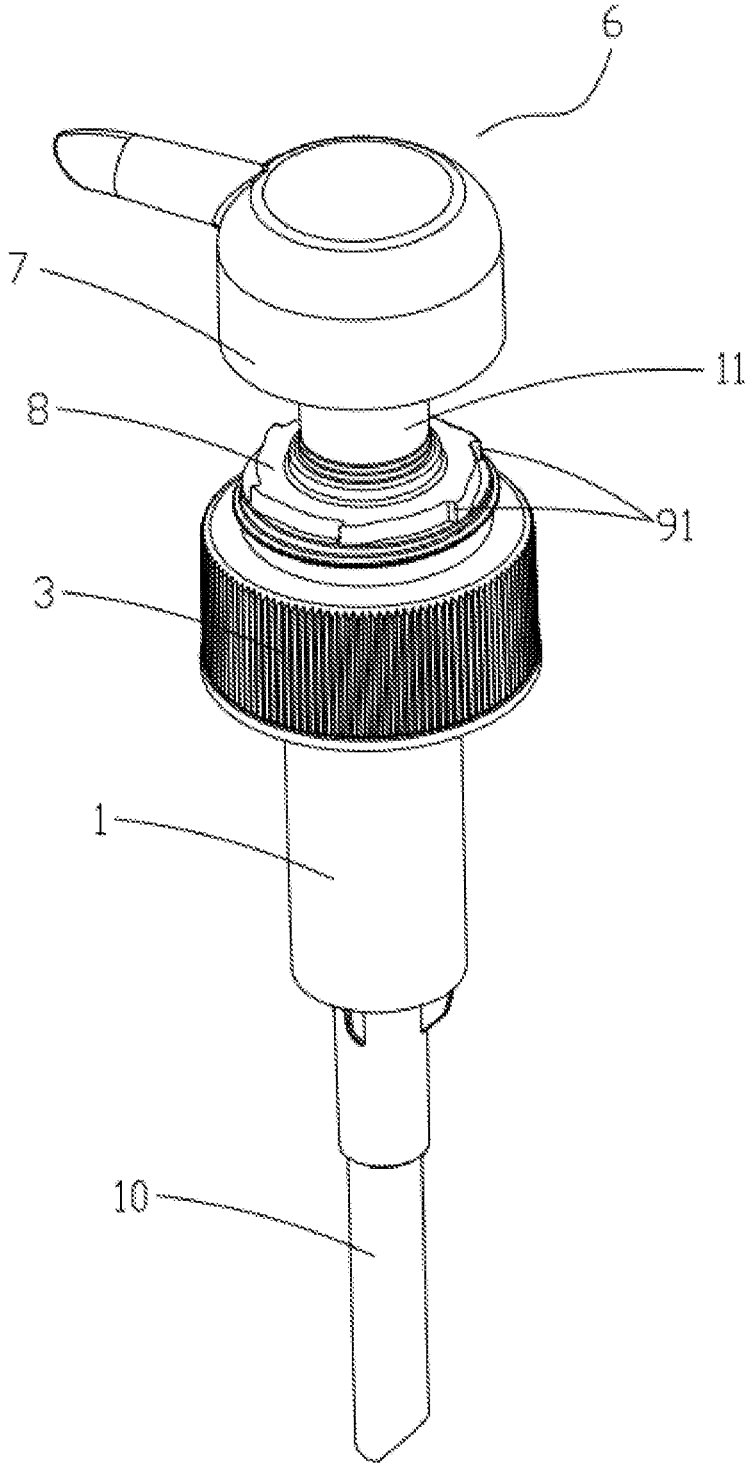
FIG. 2 is a perspective view of the invention when the connecting ring and the locking part are not connected.
Figure 7:
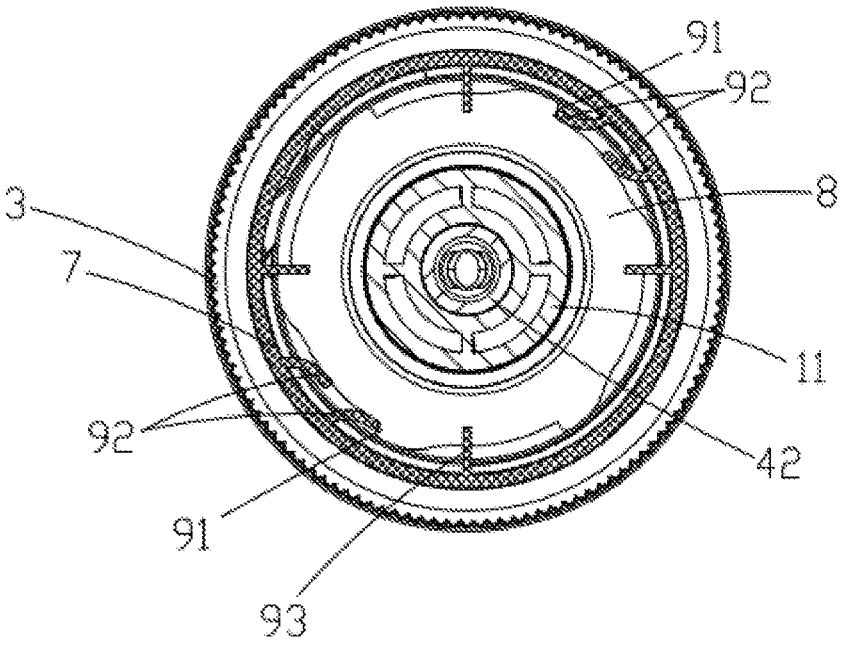
FIG. 7 is a sectional view of the invention when the connecting ring and the locking part are connected.

As shown in FIG. 2 and FIG. 7, the anti-slipping structure includes anti-slipping tooth/teeth 91 provided on the outer peripheral surface of the locking part 8, the anti-slipping tooth/teeth 91 is/are ratchet/ratchets, and the inner wall of the connecting ring 7 is provided with at least one elastic bent piece 92 which can abut against the anti-slipping tooth 91/the anti-slipping teeth 91 correspondingly to prevent the connecting ring 7 from being reversed. When the connecting ring 7 is screwed clockwise to the locking part 8, the anti-slipping tooth/teeth 91 contacts/contact the bent piece/pieces 92 correspondingly and force the bent piece/pieces 92 to deform, when the connecting ring 7 is rotated to a required position, the bent piece/pieces 92 returns/return elastically, the end part of the bent piece 92 abuts against the anti-slipping tooth 91 correspondingly, and at this moment, even if the bottle body filled with lotion is experiencing vibration or collision during shipping, the anti-slipping tooth/teeth 91 abuts/abut against the bent piece/pieces 92 respectively to prevent the connecting ring 7 from being unscrewed anti-clockwise; due to the fact that the connecting ring 7 is disposed on the bent mouth 6, the bent mouth 6 can thus not be unscrewed anticlockwise to open, so that the bent mouth 6 is prevented from being opened mistakenly to cause leakage. When a user needs to open the bent mouth 6, he/she may impose a strong force by hand to unscrew the bent mouth 6, so that the connecting ring 7 is driven along, the bent piece/pieces 92 is/are broken under the strong force, and the bent mouth 6 can be easily opened after the bent piece/pieces is/are broken. Therefore, the bent piece/pieces 92 not only prevents/prevent the bent mouth 6 from being opened by mistake which may cause leakage during shipping of the product, but also plays/play a role of anti-counterfeiting in that after the bent piece/pieces 92 is/are broken, it is impossible for some lawbreakers to replace the lotion in the bottle body with other shoddy goods without being noticed.

As shown in FIG. 7, there are six anti-slipping teeth 91 circumferentially arrayed on the locking part 8, the bent pieces 92 are in two groups and circumferentially arrayed on the connecting ring 7, and each group of the bent pieces 92 has two pieces. Therefore, it's allowed to adjust the degree of tightness properly when screwing the connecting ring 7, and when the connecting ring shows angularly offset clockwise or anticlockwise, the bent pieces 92 capable of abutting against the anti-slipping teeth 91 correspondingly are still provided, so that the reliability of the product is improved. As shown in FIG. 7, a plurality of tightening pieces 93 are further provided on an inner wall of the connecting ring 7, and when the connecting ring 7 is connected with the locking part 8, lower ends of the tightening pieces 93 abut against the locking part 8. When the connecting ring 7 is being screwed to the locking part 8, the tightening pieces 93 push the locking part 8 downwards, so that the effect of preventing the connecting ring 7 from loosening is further achieved.

Figure 3:
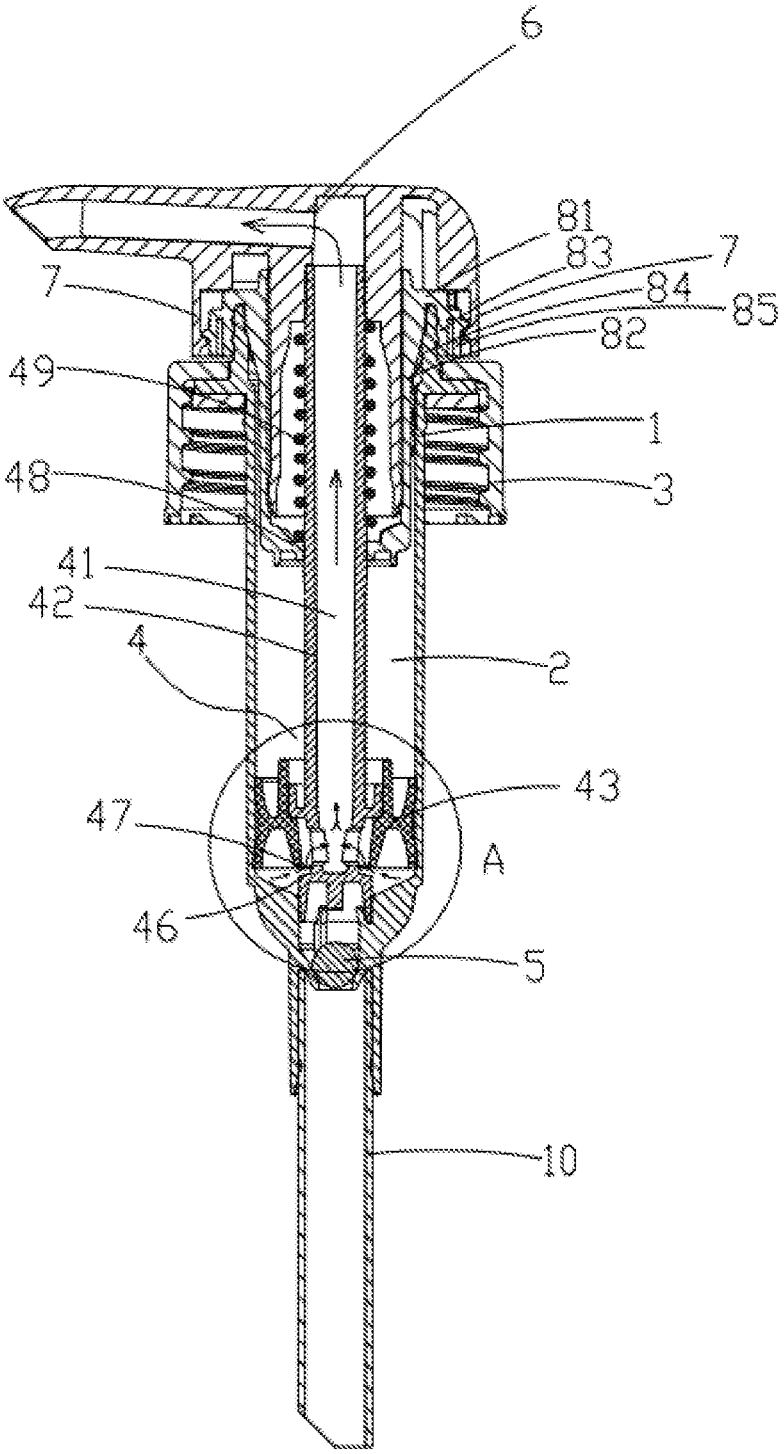
FIG. 3 is a sectional view of the invention when the bent mouth is pressed down.
Figure 4:
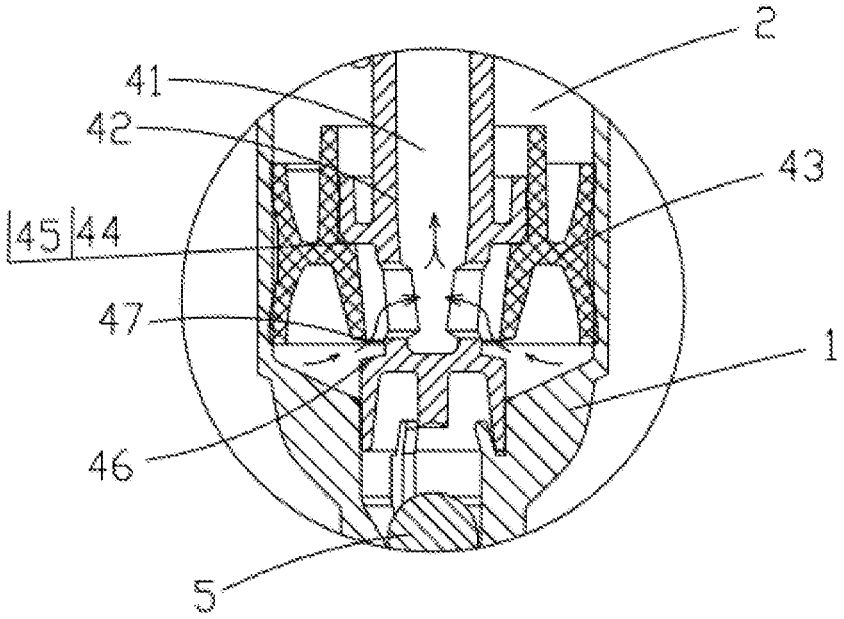
FIG. 4 is an enlarged view of part A of FIG. 3.
Figure 5:
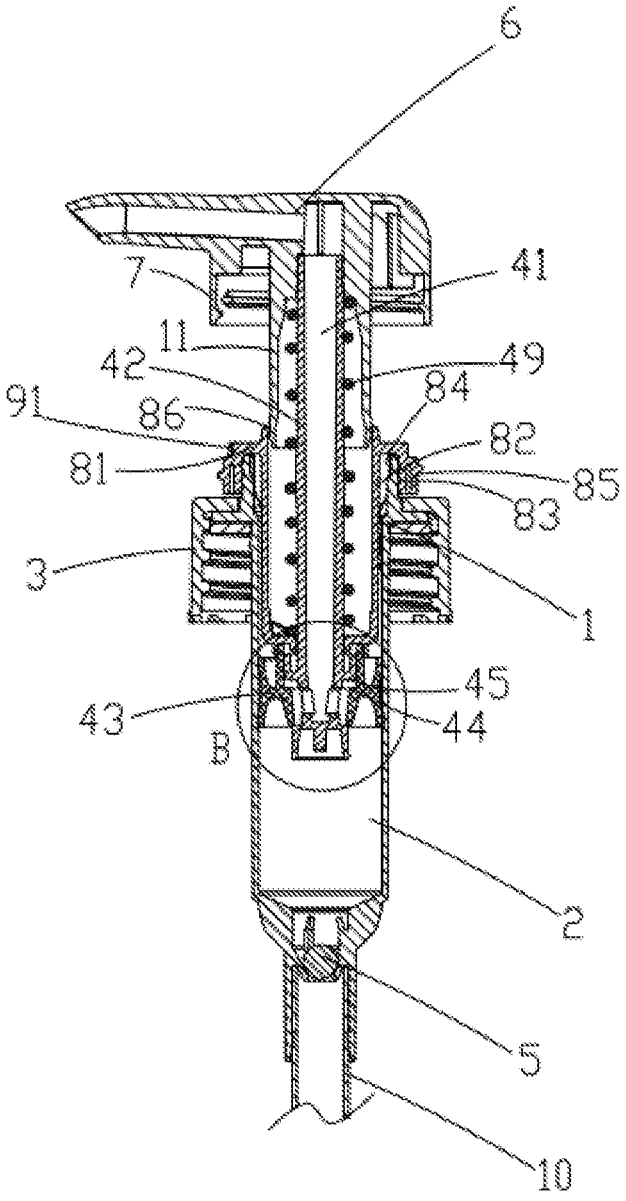
FIG. 5 is a sectional view of the invention when the connecting ring and the locking part are not connected.
Figure 6:
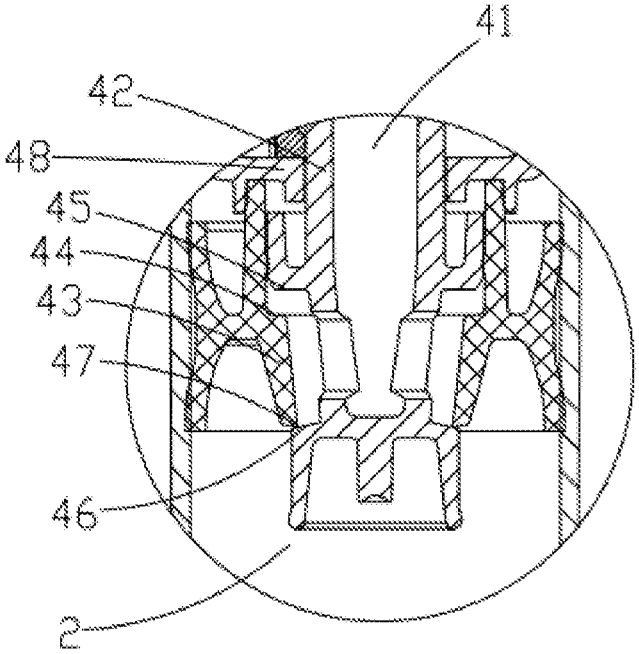
FIG. 6 is an enlarged view of part B of FIG. 5.

As shown in FIG. 3 and FIG. 5, the lower end of the pump chamber 2 is conical, and the one-way valve 5 is a pump bead provided at the lower end of the pump chamber 2.

As shown in FIG. 1 and FIG. 3, the pump body 1 is further connected with a diptube 10 below the one-way valve 5.

As shown in FIG. 3 to FIG. 6, the pumping assembly 4 comprises a pump lever 42 connected with the bent mouth 6 and having a liquid pumping channel 41, a piston 43 sleeved outside of the pump lever 42 is provided in the pump chamber 2 and divides the pump chamber 2 into an upper space and a lower space, the inner wall of the piston 43 is provided with step/steps 44, and the pump lever 42 is provided with a pushing part/pushing parts 45 which can be contacted with the step/steps 44 to push the piston 43 to move downwards when the pump lever 42 descends a certain distance, the pump lever 42 is further provided, at a lower part thereof, with an outer convex part 46, the piston 43 is provided, at the lower end thereof, with a sealing lip 47 which can be contacted with the outer convex part 46 to cut off the liquid pumping channel 41 from the pump chamber 2 when the pump lever 42 does not descend, and a fixing part 48 which can enable the pump lever 42 to slide up and down therein is further provided in the pump chamber 2 above the piston 43; and a return spring 49 which enables the outer convex part 46 and the sealing lip 47 to be contacted and sealed when the connecting ring 7 and the locking part 8 are not connected is provided between the fixing part 48 and the bent mouth 6. As shown in FIG. 5, when the connecting ring 7 is separated from the locking part 8, the return spring 49 pushes upwards against the bent mouth 6, and at this time, the sealing lip 47 of the piston 43 contacts the outer convex part 46 of the pump lever 42 to cut off the pumping channel 41 from the pump chamber 2. When lotion or liquid needs to be pumped, the bent mouth 6 is pressed downwards, the pump lever 42 moves downwards, the return spring 49 is compressed, when the pump lever 42 descends, the sealing lip 47 is immediately separated from the outer convex part 46, the liquid pumping channel 41 reaches communication with the space of the pump chamber below the piston 43, and when the pump lever 42 descends a certain distance, the pushing part/parts 45 of the pump lever 42 contacts/contact the step/steps 44 of the piston 43 and pushes/push the piston 43 to move downwards, and the downward movement of the piston 43 causes gas or liquid or lotion in the space of the pump chamber below the piston 43 to be discharged through the liquid pumping channel 41. And then the bent mouth 6 is released from pressure, the return spring 49 extends, after the pump lever 42 rises for a certain distance, the outer convex part 46 contacts the sealing lip 47 to cut off the pump chamber 2 from the liquid pumping channel 41, the piston 43 is pushed to rise by the outer convex part 46 when the pump lever 42 continues to rise, and at this moment, the air pressure between the piston 43 and the one-way valve is smaller than the air pressure in the bottle body, so the liquid or lotion in the bottle pushes away the one-way valve 5 and enters the pump chamber 2. By repeatedly pressing the bent mouth 6, the liquid or lotion in the bottle body is discharged for use, and the operation is simple and quick. The return spring 49 is no longer in contact with the lotion in the pump chamber 2, pollution to the liquid or lotion is avoided, being more environmentally friendly and hygienic. The above-mentioned "a certain distance" is theoretically larger than 0, for enabling the lowering or rising of the piston 43 is delayed relative to the lowering or rising of the pump lever 42, thereby controlling the pumping channel 41 to be communicated with or cut off from the pump chamber 2, and generally, the distance is set to be 0.5 mm to 2.0 mm (since the distance determines the size of the discharging channel opened, it can be selected according to the particle size of the solution).

As shown in FIG. 3 and FIG. 5, the locking part 8 comprises a cover body 81, the cover body 81 is provided with a cylinder 82 extending into the pump chamber 2, the fixing part 48 is disposed at the lower end of the cylinder 82, the outer side of the cylinder 82 is provided with an annular part 83 in threaded connection with the pump body 1, and a placement groove 84 for the upper end of the pump body 1 to be inserted into is formed between the annular part 83 and the cylinder 82, the outer side of the annular part 83 is provided with a peripheral ring 85 connected with the connecting ring 7 of the bent mouth 6, and the peripheral ring 85, the annular part 83, the cylinder 82, the fixing part 48 and the cover body 81 are integrally formed by injection molding. The peripheral ring 85 is located outside the annular part 83, so that when the peripheral ring 85 is connected with the connecting ring 7, the peripheral ring 85 is compressed and deformed to a certain extent, and after the connecting ring 7 is connected with the peripheral ring 85, the anti-loosening effect can be further achieved. In addition, the cylinder 82 extends into the pump chamber 2, so that the locking part 8 is more stably connected with the pump body 1.

As shown in FIG. 5, the bent mouth 6 is provided with a guide cylinder 11 which has a tapered lower end and is positioned on an inner side of the connecting ring 7 and inserted into the cylinder 82, the pump lever 42 is inserted into the guide cylinder 11 and connected with the bent mouth 6, the edge of the opening at the upper end of the cylinder 82 extends inwards to form an extension 86, and the extension 86 is tightly attached to the outer wall of the guide cylinder 11. Therefore, when the guide cylinder 11 is lifted and lowered by pressing the bent mouth 6, the guide cylinder 11 is always tightly attached to the extension 86 of the cylinder 82, water or other impurities are prevented from entering the pump chamber 2, and pollution is avoided.

What is claimed is:

1. A lotion pump, comprising:

a bottle body;

a pump body extending into the bottle body, wherein:

the pump body is provided with a pump chamber, the pump body is connected with a bottle-locking cap used for fixing the pump body to the bottle body, the pump chamber is internally provided with a pumping assembly capable of moving up and down in the pump chamber to pump lotion in the bottle body upwards, the pump chamber is provided, at the lower end thereof, with a one-way valve only for discharging the lotion in the bottle body upwards during the action of the pumping assembly, the pumping assembly is connected, at the upper end thereof, with a bent mouth for discharging the lotion, the bent mouth is provided with a connecting ring, the upper end of the pump body is provided with a locking part capable of being rotationally connected with the connecting ring, an anti-slipping structure is provided between the locking part and the connecting ring for preventing the bent mouth from being unscrewed and opened by mistake along with the connecting ring when the locking part and the connecting ring are connected, the anti-slipping structure comprises an anti-slipping tooth/anti-slipping teeth provided on the outer peripheral surface of the locking part, an elastic bending piece/elastic bending pieces are provided which can abut against the anti-slipping tooth/the anti-slipping teeth correspondingly to prevent the connecting ring from being reversed, the inner wall of the connecting ring is provided with a plurality of tightening pieces and the elastic bending piece/elastic bending pieces, with the plurality of tightening pieces and the elastic bending piece/elastic bending pieces being separate pieces of structure that are spaced from each other, a lower end of each tightening piece abuts against the locking part when the connecting ring is connected with the locking part, and the elastic bending piece/elastic bending pieces are breakable by unscrewing the bent mouth to drive the connecting ring.

2. The lotion pump according to claim 1, wherein there are six anti-slipping teeth circumferentially arrayed on the locking part, there are two groups of the bending pieces circumferentially arrayed on the connecting ring, and each group of the bending pieces has two pieces.

3. The lotion pump according to claim 2, wherein the pumping assembly includes a pump lever connected with the bent mouth and having a liquid pumping channel, a piston sleeved outside of the pump lever is provided in the pump chamber, the inner wall of the piston is provided with a step/steps, and the pump lever is provided with a pushing part/pushing parts which can be in contact with the step/steps to push the piston to move downwards when the pump lever descends a certain distance, the pump lever is further provided, at a lower part thereof, with an outer convex part, the lower end of the piston is provided with a sealing lip which can be contacted with the outer convex part to cut off the liquid pumping channel from the pump chamber when the pump lever does not descend, and a fixing part allowing the pump lever to slide up and down therein is further provided in the pump chamber above the piston; and a return spring which enables the outer convex part and the sealing lip to be contacted and sealed when the connecting ring and the locking part are not connected is provided between the fixing part and the bent mouth.

4. The lotion pump according to claim 3, wherein the locking part comprises a cover body, the cover body is provided with a cylinder extending into the pump chamber, the fixing part is disposed at the lower end of the cylinder, the outer side of the cylinder is provided with an annular part in threaded connection with the pump body, and a placement groove for the upper end of the pump body to be inserted into is formed between the annular part and the cylinder, the outer side of the annular part is further provided with a peripheral ring connected with the connecting ring of the bent mouth, and the peripheral ring, the annular part, the cylinder, the fixing part and the cover body are integrally formed by injection molding.

5. The lotion pump according to claim 4, wherein the bent mouth is provided with a guide cylinder which is positioned on the inner side of the connecting ring and inserted into the cylinder, the pump lever is inserted into the guide cylinder and connected with the bent mouth, an edge of the opening at the upper end of the cylinder extends inwards to form an extension, and the extension is attached to the outer wall of the guide cylinder.

6. The lotion pump according to claim 5, wherein the lower end of the guide cylinder is tapered, and the anti-slipping tooth/the anti-slipping teeth is/are ratchet/ratchets.

7. The lotion pump according to claim 1, wherein the lower end of the pump chamber is conical, and the one-way valve is a pump bead provided at the lower end of the pump chamber.

8. The lotion pump according to claim 1, wherein a diptube is further connected to the pump body below the one-way valve.

* * * * *